US010720132B2

(12) United States Patent
Maezawa

(10) Patent No.: US 10,720,132 B2
(45) Date of Patent: Jul. 21, 2020

(54) PERFORMANCE CONTROL METHOD AND PERFORMANCE CONTROL DEVICE

(71) Applicant: Yamaha Corporation, Hamamatsu, Shizuoka (JP)

(72) Inventor: Akira Maezawa, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 16/376,714

(22) Filed: Apr. 5, 2019

(65) Prior Publication Data

US 2019/0237055 A1 Aug. 1, 2019

Related U.S. Application Data

(63) Continuation of application No. PCT/JP2017/035824, filed on Oct. 2, 2017.

(30) Foreign Application Priority Data

Oct. 11, 2016 (JP) ..... 2016-200130

(51) Int. Cl.
*G10H 1/40* (2006.01)
*G10H 1/00* (2006.01)
(Continued)

(52) U.S. Cl.
CPC ..... *G10H 1/40* (2013.01); *G10G 1/00* (2013.01); *G10G 3/04* (2013.01); *G10H 1/00* (2013.01);
(Continued)

(58) Field of Classification Search
CPC .. G10H 1/40; G10H 1/00; G10H 1/36; G10H 1/0008; G10H 2210/071; G10H 2210/005;
(Continued)

(56) References Cited

U.S. PATENT DOCUMENTS 5,913,259 A * 6/1999 Grubb ..... G10H 1/36 84/610
5,942,710 A 8/1999 Hayakawa et al.
(Continued)

FOREIGN PATENT DOCUMENTS

JP H10-254448 A 9/1998
JP 2001-195063 A 7/2001
(Continued)

OTHER PUBLICATIONS

International Search Report in PCT/JP2017/035824 dated Dec. 19, 2017.
(Continued)

*Primary Examiner* — Jeffrey Donels
(74) *Attorney, Agent, or Firm* — Global IP Counselors, LLP

(57) ABSTRACT

A performance control method includes estimating a performance position in a musical piece by analyzing a performance of the musical piece by a performer, causing a performance device to execute an automatic performance in accordance with performance data designating the performance content of the musical piece so as to be synchronized with the progress of the performance position, and controlling the relationship between the progress of the performance position and the automatic performance in accordance with control data that is independent of the performance data.

18 Claims, 3 Drawing Sheets

(51) Int. Cl.
*G10G 3/04* (2006.01)
*G10H 1/36* (2006.01)
*G10G 1/00* (2006.01)

(52) U.S. Cl.
CPC ..... *G10H 1/0008* (2013.01); *G10H 1/36* (2013.01); *G10H 2210/005* (2013.01); *G10H 2210/066* (2013.01); *G10H 2210/071* (2013.01); *G10H 2210/076* (2013.01); *G10H 2220/091* (2013.01)

(58) Field of Classification Search
CPC ..... G10H 2210/066; G10H 2220/091; G10H 2210/076; G10H 2220/015; G10H 2240/325; G10H 2210/091; G10H 1/368; G10G 1/00; G10G 3/04
See application file for complete search history.

(56) References Cited

U.S. PATENT DOCUMENTS 5,952,597 A * 9/1999 Weinstock ..... G10G 3/04 84/477 R
6,166,314 A * 12/2000 Weinstock ..... G10G 3/04 84/477 R
8,660,678 B1 * 2/2014 Lavi ..... G10H 1/0066 700/94
2001/0007221 A1 7/2001 Uehara
2011/0214554 A1 * 9/2011 Nakadai ..... G09B 15/02 84/477 R
2018/0102119 A1 * 4/2018 Yamamoto ..... G10H 1/0008

FOREIGN PATENT DOCUMENTS

JP 2006-065253 A 3/2006
JP 2007-241181 A 9/2007
JP 2007-249033 A 9/2007
JP 2015-079183 A 4/2015

OTHER PUBLICATIONS

Translation of Office Action in the corresponding Japanese Patent Application No. 2016-200130, dated Apr. 24, 2020.

* cited by examiner

PERFORMANCE CONTROL METHOD AND PERFORMANCE CONTROL DEVICE

CROSS-REFERENCE TO RELATED APPLICATIONS

This application is a continuation application of International Application No. PCT/JP2017/035824, filed on Oct. 2, 2017, which claims priority to Japanese Patent Application No. 2016-200130 filed in Japan on Oct. 11, 2016. The entire disclosures of International Application No. PCT/JP2017/035824 and Japanese Patent Application No. 2016-200130 are hereby incorporated herein by reference.

BACKGROUND

Technological Field

The present invention relates to a technology for controlling an automatic performance.

Background Information

Japanese Laid-Open Patent Application No. 2015-79183, for example, discloses a score alignment technique for estimating a position in a musical piece that is currently being played (hereinafter referred to as "performance position") by means of analyzing a performance of a musical piece has been proposed in the prior art.

On the other hand, conventionally, automatic performance techniques to make an instrument, such as keyboard instrument, generate sound using performance data which represents the performance content of a musical piece are widely used. If estimation results of the performance position are applied to an automatic performance, it is possible to achieve an automatic performance that is synchronized with the performance (hereinafter referred to as "actual performance") of a musical instrument by a performer. However, various problems could occur in a scenario in which the estimation results of the performance position are actually applied to the automatic performance. For example, in a portion of a musical piece in which there is an extreme change in the tempo of the actual performance, in practice, it is difficult to cause the automatic performance to follow the actual performance with high precision.

SUMMARY

In consideration of such circumstances, an object of the present disclosure is to solve various problems that could occur during synchronization of the automatic performance with the actual performance.

In order to solve the problem described above, a performance control method according to a preferred aspect of this disclosure comprises estimating, by an electronic controller, a performance position in a musical piece by analyzing a performance of the musical piece by a performer, causing, by the electronic controller, a performance device to execute an automatic performance corresponding to performance data that designates a performance content of the musical piece so as to be synchronized with the progress of the performance position, and controlling, by the electronic controller, a relationship between the progress of the performance position and the automatic performance in accordance with control data that is independent of the performance data.

In addition, a performance control device according to a preferred aspect of this disclosure comprises an electronic controller including at least one processor, and the electronic controller is configured to execute a plurality of modules including a performance analysis module that estimates a performance position in a musical piece by analyzing a performance of the musical piece by a performer, and a performance control module that causes a performance device to execute an automatic performance corresponding to performance data that designates the performance content of the musical piece so as to be synchronized with the progress of the performance position. The performance control module controls a relationship between the progress of the performance position and the automatic performance in accordance with control data that is independent of the performance data.

DETAILED DESCRIPTION OF THE EMBODIMENTS

Selected embodiments will now be explained with reference to the drawings. It will be apparent to those skilled in the field of musical performances from this disclosure that the following descriptions of the embodiments are provided for illustration only and not for the purpose of limiting the invention as defined by the appended claims and their equivalents.

First Embodiment

Figure 1:
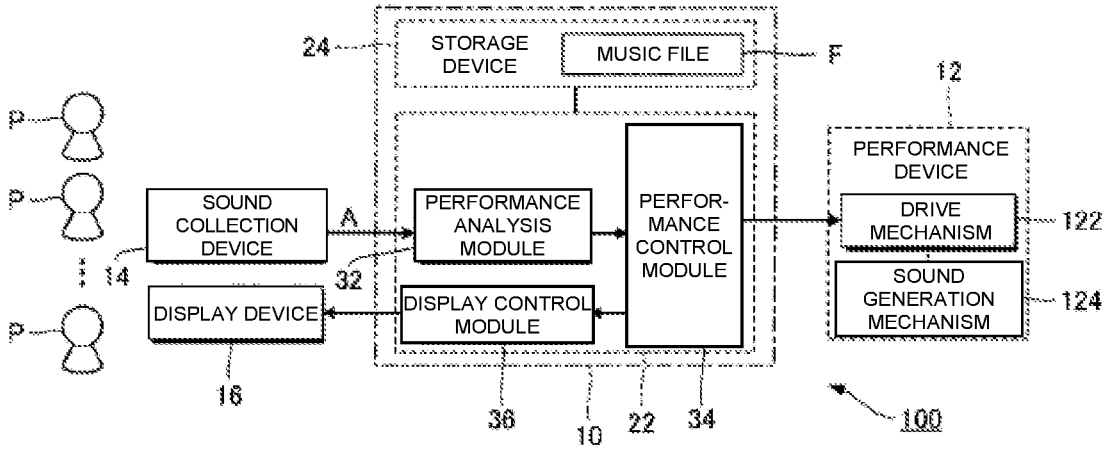
FIG. 1 is a block diagram of an automatic performance system according to a first embodiment.

FIG. 1 is a block diagram of an automatic performance system 100 according to a first embodiment. The automatic performance system 100 is a computer system that is installed in a space in which a plurality of performers P play musical instruments, such as a music hall, and that executes, parallel with the performance of a musical piece by the plurality of performers P, an automatic performance of the musical piece. Although the performers P are typically performers of musical instruments, singers of musical pieces can also be the performers P. In addition, those persons who are not responsible for actually playing a musical instrument (for example, a conductor that leads the performance of the musical piece or a sound director) can also be included in the performers P. As illustrated in FIG. 1, the automatic performance system 100 according to the first embodiment comprises a performance control device 10, a performance device 12, a sound collection device 14, and a display device 16. The performance control device 10 is a computer system that controls each element of the automatic performance system 100 and is realized by an information processing device, such as a personal computer.

The performance device 12 executes an automatic performance of a musical piece under the control of the performance control device 10. Among the plurality of parts that constitute the musical piece, the performance device 12 according to the first embodiment executes an automatic performance of a part other than the parts performed by the plurality of performers P. For example, a main melody part of the musical piece is performed by the plurality of performers P, and the automatic performance of an accompaniment part of the musical piece is executed by the performance device 12.

As illustrated in FIG. 1, the performance device 12 of the first embodiment is an automatic performance instrument (for example, an automatic piano) comprising a drive mechanism 122 and a sound generation mechanism 124. In the same manner as a keyboard instrument of a natural musical instrument, the sound generation mechanism 124 has, associated with each key, a string striking mechanism that causes a string (sound-generating body) to generate sounds in conjunction with the displacement of each key of a keyboard. The string striking mechanism corresponding to any given key comprises a hammer that is capable of striking a string and a plurality of transmitting members (for example, whippens, jacks, and repetition levers) that transmit the displacement of the key to the hammer. The drive mechanism 122 executes the automatic performance of the musical piece by driving the sound generation mechanism 124. Specifically, the drive mechanism 122 is configured comprising a plurality of driving bodies (for example, actuators, such as solenoids) that displace each key, and a drive circuit that drives each driving body. The automatic performance of the musical piece is realized by the drive mechanism 122 driving the sound generation mechanism 124 in accordance with instructions from the performance control device 10. The performance control device 10 can also be mounted on the performance device 12.

As illustrated in FIG. 1, the performance control device 10 is realized by a computer system comprising an electronic controller 22 and a storage device 24. The term "electronic controller" as used herein refers to hardware that executes software programs. The electronic controller 22 includes a processing circuit, such as a CPU (Central Processing Unit) having at least one processor that comprehensively controls the plurality of elements (performance device 12, sound collection device 14, and display device 16) that constitute the automatic performance system 100. The electronic controller 22 can be configured to comprise, instead of the CPU or in addition to the CPU, programmable logic devices such as a DSP (Digital Signal Processor), an FPGA (Field Programmable Gate Array), and the like. In addition, the electronic controller 22 can include a plurality of CPUs (or a plurality of programmable logic devices). The storage device 24 is configured from a known storage medium, such as a magnetic storage medium or a semiconductor storage medium, or from a combination of a plurality of types of storage media, and stores a program that is executed by the electronic controller 22, and various data that are used by the electronic controller 22. The storage device 24 is any computer storage device or any computer readable medium with the sole exception of a transitory, propagating signal. For example, the storage device 24 can be a computer memory device which can be nonvolatile memory and volatile memory. Moreover, the storage device 24 that is separate from the automatic performance system 100 (for example, cloud storage) can be prepared, and the electronic controller 22 can read from or write to the storage device 24 via a communication network, such as a mobile communication network or the Internet. That is, the storage device 24 can be omitted from the automatic performance system 100.

Figure 2:
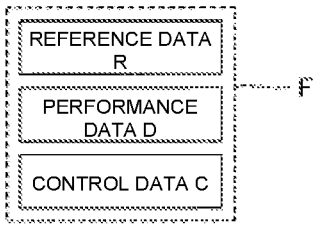
FIG. 2 is a schematic view of a music file.

The storage device 24 of the present embodiment stores a music file F of the musical piece. The music file F is, for example, a file in a format conforming to the MIDI (Musical Instrument Digital Interface) standard (SMF: Standard MIDI File). As illustrated in FIG. 2, the music file F of the first embodiment is one file that includes reference data R, performance data D, and control data C.

The reference data R designates performance content of the musical piece performed by the plurality of performers P (for example, a sequence of notes that constitute the main melody part of the musical piece). Specifically, the reference data R is MIDI format time-series data, in which are arranged, in a time series, instruction data indicating the performance content (sound generation/mute) and time data indicating the processing time point of said instruction data. The performance data D, on the other hand, designates the performance content of the automatic performance performed by the performance device 12 (for example, a sequence of notes that constitute the accompaniment part of the musical piece). Specifically, like the reference data R, the performance data D is MIDI format time-series data, in which are arranged, in a time series, instruction data indicating the performance content and time data indicating the processing time point of said instruction data. The instruction data in each of the reference data R and the performance data D assigns pitch and intensity and provides instruction for various events, such as sound generation and muting. In addition, the time data in each of the reference data R and the performance data D designates, for example, an interval for successive instruction data. The performance data D of the first embodiment also designates the tempo (performance speed) of the musical piece.

The control data C is data for controlling the automatic performance of the performance device 12 corresponding to the performance data D. The control data C is data that constitutes one music file F together with the reference data R and the performance data D, but is independent of the reference data R and the performance data D. Specifically, the control data C can be edited separately from the reference data R and the performance data D. That is, it is possible to edit the control data C independently, without affecting the contents of the reference data R and the performance data D. For example, the reference data R, the performance data D, and the control data C are data of mutually different MIDI channels in one music file F. The above-described configuration, in which the control data C is included in one music file F together with the reference data R and the performance data D, has the advantage that it is easier to handle the control data C, compared with a configuration in which the control data C is in a separate file from the reference data R and the performance data D. The specific content of the control data C will be described further below.

The sound collection device 14 of FIG. 1 generates an audio signal A by collecting sounds generated by the performance of musical instruments by the plurality of performers P (for example, instrument sounds or singing sounds). The audio signal A represents the waveform of the sound. Moreover, the audio signal A that is output from an electric musical instrument, such as an electric string instrument, can also be used. Therefore, the sound collection device 14 can be omitted. The audio signal A can also be generated by adding signals that are generated by a plurality of the sound collection devices 14.

The display device 16 displays various images under the control of the performance control device 10 (electronic controller 22). For example, a liquid-crystal display panel or a projector is a preferred example of the display device 16. The plurality of performers P can visually check the image displayed by the display device 16 at any time, parallel with the performance of the musical piece.

The electronic controller 22 has a plurality of functions for realizing the automatic performance of the musical piece (performance analysis module 32; performance control module 34; and display control module 36) by the execution of a program that is stored in the storage device 24. Moreover, a configuration in which the functions of the electronic controller 22 are realized by a group of a plurality of devices (that is, a system), or a configuration in which some or all of the functions of the electronic controller 22 are realized by a dedicated electronic circuit, can also be employed. In addition, a server device, which is located away from the space in which the sound collection device 14, the performance device 12, and the display device 16 are installed, such as a music hall, can realize some or all of the functions of the electronic controller 22.

The performance analysis module 32 estimates the position (hereinafter referred to as "performance position") T in the musical piece where the plurality of performers P are currently playing. Specifically, the performance analysis module 32 estimates the performance position T by analyzing the audio signal A that is generated by the sound collection device 14. The estimation of the performance position T by the performance analysis module 32 is sequentially executed in real time, parallel with the performance (actual performance) by the plurality of performers P. For example, the estimation of the performance position T is repeated at a prescribed period.

The performance analysis module 32 of the first embodiment estimates the performance position T by crosschecking the sound represented by the audio signal A and the performance content indicated by the reference data R in the music file F (that is, the performance content of the main melody part to be played by the plurality of performers P). A known audio analysis technology (score alignment technology) can be freely employed for the estimation of the performance position T by the performance analysis module 32. For example, the analytical technique disclosed in Japanese Laid-Open Patent Application No. 2015-79183 can be used for estimating the performance position T. In addition, an identification model such as a neural network or a k-ary tree can be used for estimating the performance position T. For example, machine learning of the identification model (for example, deep learning) is performed in advance by using the feature amount of the sounds generated by the actual performance as learning data. The performance analysis module 32 estimates the performance position T by applying the feature amount extracted from the audio signal A, in a scenario in which the automatic performance is actually carried out, to the identification model after the machine learning.

The performance control module 34 of FIG. 1 causes the performance device 12 to execute the automatic performance corresponding to the performance data D in the music file F. The performance control module 34 of the first embodiment causes the performance device 12 to execute the automatic performance so as to be synchronized with the progress of the performance position T (movement on a time axis) that is estimated by the performance analysis module 32. More specifically, the performance control module 34 provides instruction to the performance device 12 to perform the performance content specified by the performance data D with respect to the point in time that corresponds to the performance position T in the musical piece. In other words, the performance control module 34 functions as a sequencer that sequentially supplies each piece of instruction data included in the performance data D to the performance device 12.

The performance device 12 executes the automatic performance of the musical piece in accordance with the instructions from the performance control module 34. Since the performance position T moves over time toward the end of the musical piece as the actual performance progresses, the automatic performance of the musical piece by the performance device 12 will also progress with the movement of the performance position T. That is, the automatic performance of the musical piece by the performance device 12 is executed at the same tempo as the actual performance. As can be understood from the foregoing explanation, the performance control module 34 provides instruction to the performance device 12 to carry out the automatic performance so that the automatic performance will be synchronized with (that is, temporally follows) the actual performance, while maintaining the intensity of each note and the musical expressions, such as phrase expressions, of the musical piece, with regard to the content specified by the performance data D. Thus, for example, if performance data D that represents the performance of a specific performer, such as a performer who is no longer alive, are used, it is possible to create an atmosphere as if the performer were cooperatively and synchronously playing together with a plurality of actual performers P, while accurately reproducing musical expressions that are unique to said performer by means of the automatic performance.

Moreover, in practice, time on the order of several hundred milliseconds is required for the performance device 12 to actually generate a sound (for example, for the hammer of the sound generation mechanism 124 to strike a string), after the performance control module 34 provides instruction for the performance device 12 to carry out the automatic performance by means of an output of instruction data in the performance data D. That is, the actual generation of sound by the performance device 12 can be delayed with respect to the instruction from the performance control module 34. Therefore, the performance control module 34 can also provide instruction to the performance device 12 regarding the performance at a point in time that is later (in the future) than the performance position T in the musical piece estimated by the performance analysis module 32.

The display control module 36 of FIG. 1 causes the display device 16 to display an image (hereinafter referred to as "performance image") that visually expresses the progress of the automatic performance of the performance device 12. Specifically, the display control module 36 causes the display device 16 to display the performance image by generating image data that represents the performance image and outputting the image data to the display device 16. The display control module 36 of the first embodiment causes the display device 16 to display a moving image, which changes dynamically in conjunction with the automatic performance of the performance device 12, as the performance image.

Figure 3:
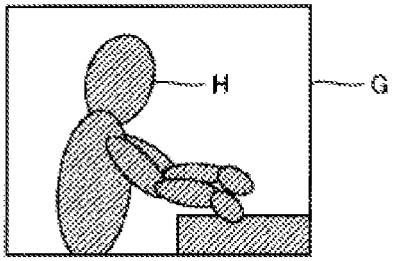
FIG. 3 is a schematic view of a performance image.

FIG. 3 shows examples of displays of the performance image G. As illustrated in FIG. 3, the performance image G is, for example, a moving image that expresses a virtual performer (hereinafter referred to as "virtual performer") i playing an instrument in a virtual space. The display control module 36 changes the performance image G over time, parallel with the automatic performance of the performance device 12, such that depression or release of the keys by the virtual performer H is simulated at the point in time of the instruction of sound generation or muting to the performance device 12 (output of instruction data for instructing sound generation). Accordingly, by visually checking the performance image G displayed on the display device 16, each performer P can visually grasp the point in time at which the performance device 12 generates each note of the musical piece from the motion of the virtual performer H.

Figure 4:
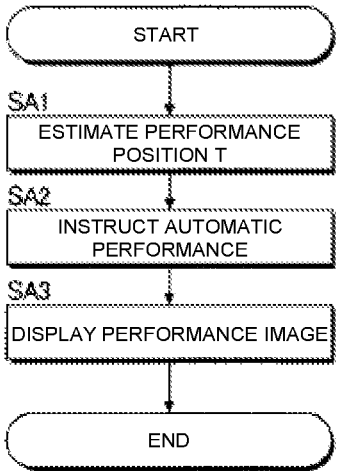
FIG. 4 is a flow chart of an operation in which a control device causes a performance device to execute an automatic performance.

FIG. 4 is a flowchart illustrating the operation of the electronic controller 22. For example, the process of FIG. 4, triggered by an interruption that is generated at a prescribed period, is executed parallel with the actual performance of the musical piece by the plurality of performers P. When the process of FIG. 4 is started, the electronic controller 22 (performance analysis module 32) analyzes the audio signal A supplied from the sound collection device 14 to thereby estimate the performance position T (SA1). The electronic controller 22 (performance control module 34) provides instruction to the performance device 12 regarding the automatic performance corresponding to the performance position T (SA2). Specifically, the electronic controller 22 causes the performance device 12 to execute the automatic performance of the musical piece so as to be synchronized with the progress of the performance position T estimated by the performance analysis module 32. The electronic controller 22 (display control module 36) causes the display device 16 to display the performance image G that represents the progress of the automatic performance and changes the performance image G as the automatic performance progresses.

As described above, in the first embodiment, the automatic performance of the performance device 12 is carried out so as to be synchronized with the progress of the performance position T, while the display device 16 displays the performance image G representing the progress of the automatic performance of the performance device 12. Thus, each performer P can visually check the progress of the automatic performance of the performance device 12 and can reflect the visual confirmation in the performer's own performance. According to the foregoing configuration, a natural ensemble is realized, in which the actual performance of a plurality of performers P and the automatic performance by the performance device 12 interact with each other. In other words, each performer P can perform as if the performer were actually playing an ensemble with the virtual performer H. In particular, in the first embodiment, there is the benefit that the plurality of performers P can visually and intuitively grasp the progress of the automatic performance, since the performance image G, which changes dynamically in accordance with the performance content of the automatic performance, is displayed on the display device 16.

The control data C included in the music file F will be described in detail below. Briefly, the performance control module 34 of the first embodiment controls the relationship between the progress of the performance position T and the automatic performance of the performance device 12 in accordance with the control data C in the music file F. The control data C is data for designating a part of the musical piece to be controlled (hereinafter referred to as "control target part"). For example, one arbitrary control target part is specified by the time of the start point of said part, as measured from the start point of the musical piece, and the duration (or the time of the end point). One or more control target parts are designated in the musical piece by the control data C.

Figure 5:
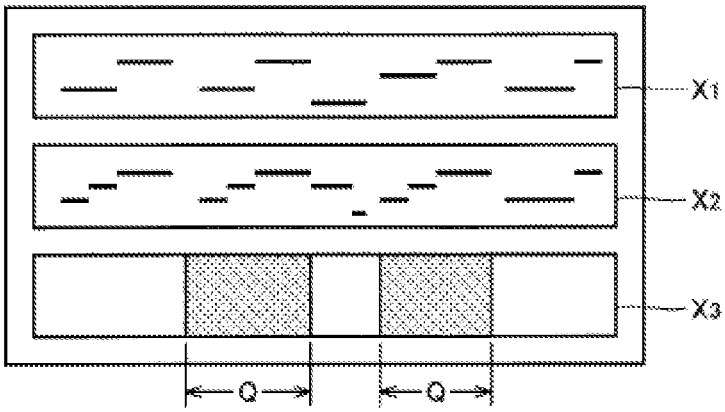
FIG. 5 is a schematic view of a music file editing screen.

FIG. 5 is an explanatory view of a screen that is displayed on the display device 16 (hereinafter referred to as "editing screen") when an editor of the music file F edits the music file F. As illustrated in FIG. 5, the editing screen includes an area X1, an area X2, and an area X3. A time axis (horizontal axis) and a pitch axis (vertical axis) are set for each of the area X1 and the area X2. The sequence of notes of the main melody part indicated by the reference data R is displayed in the area X1, and the sequence of notes of the accompaniment part indicated by the performance data D is displayed in the area X2. The editor can provide instruction for the editing of the reference data R by means of an operation on the area X1 and provide instruction for the editing of the performance data D by means of an operation on the area X2.

On the other hand, a time axis (horizontal axis) common to the areas X1 and X2 is set in the area X3. The editor can designate any one or more sections of the musical piece as the control target parts Q by means of an operation on the area X3. The control data C designates the control target parts Q instructed in the area X3. The reference data R in the area X1, the performance data D in the area X2, and the control data C in the area X3 can be edited independently of each other. That is, the control data C can be changed without changing the reference data R and the performance data D.

Figure 6:
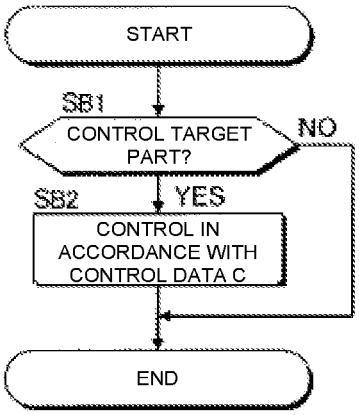
FIG. 6 is a flow chart of an operation in which the control device uses control data.

FIG. 6 is a flow chart of a process in which the electronic controller 22 uses the control data C. For example, the process of FIG. 6, triggered by an interruption that is generated at a prescribed period after the start of the automatic performance, is executed parallel with the automatic performance by means of the process of FIG. 4. When the process of FIG. 6 is started, the electronic controller 22 (performance control module 34) determines whether the control target part Q has arrived (SB1). If the control target part Q has arrived (SB1: YES), the electronic controller 22 executes a process corresponding to the control data C (SB2). If the control target part Q has not arrived (SB1: NO), the process corresponding to the control data C is not executed.

The music file F of the first embodiment includes control data C1 for controlling the tempo of the automatic performance of the performance device 12 as the control data C. The control data C1 is used to provide instruction for the initialization of the tempo of the automatic performance in the control target part Q in the musical piece. More specifically, the performance control module 34 of the first embodiment initializes the tempo of the automatic performance of the performance device 12 to a prescribed value designated by the performance data D in the control target part Q of the musical piece designated by the control data C1 and maintains said prescribed value in the control target part Q (SB2). On the other hand, in sections other than the control target part Q, as described above, the performance control module 34 advances the automatic performance at the same tempo as the actual performance of the plurality of performers P. As can be understood from the foregoing explanation, the automatic performance which has been proceeding at the same variable tempo as the actual performance before the start of the control target part Q in the musical piece, upon being triggered by the arrival of the control target part Q, is initialized to the standard tempo designated by the performance data D. After passing the control target part Q, the control of the tempo of the automatic performance corresponding to the performance position T of the actual performance is resumed, and the tempo of the automatic performance is set to the same variable tempo as the actual performance.

For example, the control data C1 is generated in advance such that locations in the musical piece where the tempo of the actual performance by the plurality of performers P is likely to change are included in the control target part Q. Accordingly, the possibility of the tempo of the automatic performance changing unnaturally in conjunction with the tempo of the actual performance is reduced, and it is possible to realize the automatic performance at the appropriate tempo.

Second Embodiment

The second embodiment will now be described. In each of the embodiments illustrated below, elements that have the same actions or functions as in the first embodiment have been assigned the same reference symbols as those used to describe the first embodiment, and detailed descriptions thereof have been appropriately omitted.

The music file F of the second embodiment includes control data C2 for controlling the tempo of the automatic performance of the performance device 12 as the control data C. The control data C2 is used to provide instruction for the maintenance of the tempo of the automatic performance in the control target part Q in the musical piece. More specifically, the performance control module 34 of the second embodiment maintains the tempo of the automatic performance of the performance device 12 in the control target part Q of the musical piece designated by the control data C2 at the tempo of the automatic performance immediately before the start of said control target part Q (SB2). That is, in the control target part Q, the tempo of the automatic performance does not change even if the tempo of the actual performance changes, in the same manner as in the first embodiment. On the other hand, in sections other than the control target part Q, the performance control module 34 advances the automatic performance at the same tempo as the actual performance by the plurality of performers P, in the same manner as in the first embodiment. As can be understood from the foregoing explanation, the automatic performance which has been proceeding at the same variable tempo as the actual performance before the start of the control target part Q in the musical piece, upon being triggered by the arrival of the control target part Q, is fixed to the tempo immediately before the control target part Q. After passing the control target part Q, the control of the tempo of the automatic performance corresponding to the performance position T of the actual performance is resumed, and the tempo of the automatic performance is set to the same tempo as the actual performance.

For example, the control data C2 is generated in advance such that locations where the tempo of the actual performance can change for the purpose of musical expressions but the tempo of the automatic performance should be held constant are included in the control target part Q. Accordingly, it is possible to realize the automatic performance at the appropriate tempo in parts of the musical piece where the tempo of the automatic performance should be maintained even if the tempo of the actual performance changes.

As can be understood from the foregoing explanation, the performance control module 34 of the first embodiment and the second embodiment cancels the control for synchronizing the automatic performance with the progress of the performance position T in the control target part Q of the musical piece designated by the control data C (C1 or C2).

Third Embodiment

The music file F of the third embodiment includes control data C3 for controlling relationship between the progress of the performance position T and the automatic performance as the control data C. The control data C3 is used to provide instruction for the degree to which the progress of the performance position T is reflected in the automatic performance (hereinafter referred to as "performance reflection degree") in the control target part Q in the musical piece. Specifically, the control data C3 designates the control target part Q in the musical piece and the temporal change in the performance reflection degree in said control target part Q. It is possible to designate the temporal change in the performance reflection degree for each of a plurality of control target parts Q in the musical piece with the control data C3. The performance control module 34 of the third embodiment controls the performance reflection degree relating to the automatic performance by the performance device 12 in the control target part Q in the musical piece in accordance with the control data C3. That is, the performance control module 34 controls the timing of the output of the instruction data corresponding to the progress of the performance position T such that the performance reflection degree changes to a value corresponding to the instruction by the control data C3. On the other hand, in sections other than the control target part Q, the performance control module 34 controls the automatic performance of the performance device 12 in accordance with the performance position T such that the performance reflection degree relating to the automatic performance is maintained at a prescribed value.

As described above, in the third embodiment, the performance reflection degree in the control target part Q of the musical piece is controlled in accordance with the control data C3. Accordingly, it is possible to realize a diverse automatic performance in which the degree to which the automatic performance follows the actual performance is changed in specific parts of the musical piece.

Fourth Embodiment

Figure 7:
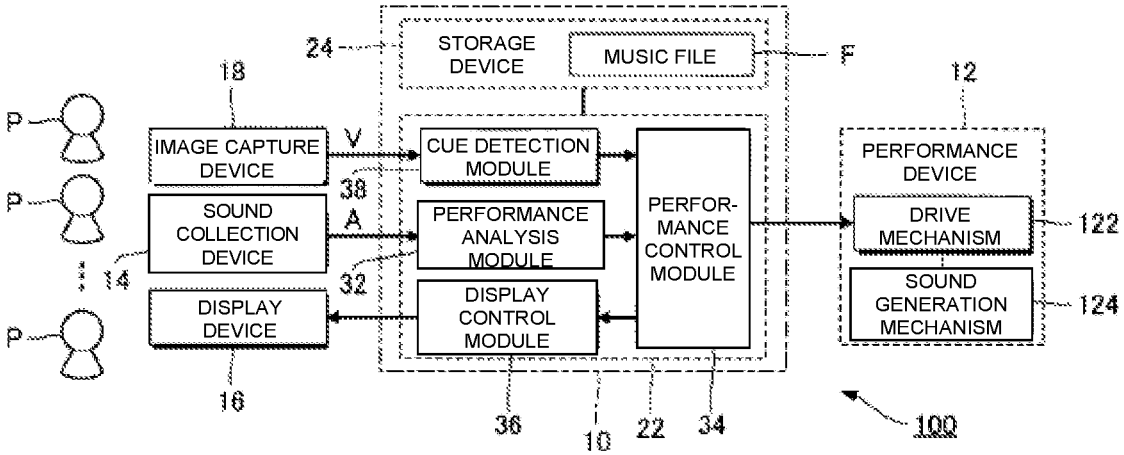
FIG. 7 is a block diagram of an automatic performance system according to a second embodiment.

FIG. 7 is a block diagram of the automatic performance system 100 according to a fourth embodiment. The automatic performance system 100 according to the fourth embodiment comprises an image capture device 18 in addition to the same elements as in the first embodiment (performance control device 10, performance device 12, sound collection device 14, and display device 16). The image capture device 18 generates an image signal V by imaging the plurality of performers P. The image signal V is a signal representing a moving image of a performance by the plurality of performers P. A plurality of the image capturing devices 18 can be installed.

As illustrated in FIG. 7, the electronic controller 22 of the performance control device 10 in the fourth embodiment also functions as a cue detection module 38, in addition to the same elements as in the first embodiment (performance analysis module 32, performance control module 34, and display control module 36), by the execution of a program that is stored in the storage device 24.

Among the plurality of performers P, a specific performer P (hereinafter referred to as "specific performer P") who leads the performance of the musical piece makes a motion that serves as a cue (hereinafter referred to as "cueing motion") for the performance of the musical piece. The cueing motion is a motion (gesture) that indicates one point on a time axis (hereinafter referred to as "target time point"). For example, the motion of the specific performer P picking up their musical instrument or the motion of the specific performer P moving their body are preferred examples of cueing motions. The target time point is, for example, the start point of the performance of the musical piece or the point in time at which the performance is resumed after a long rest in the musical piece. The specific performer P makes the cueing motion at a point in time ahead of the target time point by a prescribed period of time (hereinafter referred to as "cueing interval"). The cueing interval is, for example, a time length corresponding to one beat of the musical piece. The cueing motion is a motion that gives advance notice of the arrival of the target time point after the lapse of the cueing interval, and, as well as being used as a trigger for the automatic performance by the performance device 12, the cueing motion serves as a trigger for the performance of the performers P other than the specific performer P.

The cue detection module 38 of FIG. 7 detects the cueing motion made by the specific performer P. Specifically, the cue detection module 38 detects the cueing motion by analyzing an image that captures the specific performer P taken by the image capture device 18. A known image analysis technique, which includes an image recognition process for extracting from an image an element (such as a body or a musical instrument) that is moved at the time the specific performer P makes the cueing motion and a moving body detection process for detecting the movement of said element, can be used for detecting the cueing motion by means of the cue detection module 38. In addition, an identification model such as a neural network or a k-ary tree can be used to detect the cueing motion. For example, machine learning of the identification model (for example, deep learning) is performed in advance by using, as learning data, the feature amount extracted from the image signal capturing the performance of the specific performer P. The cue detection module 38 detects the cueing motion by applying the feature amount, extracted from the image signal V of a scenario in which the automatic performance is actually carried out, to the identification model after machine learning.

The performance control module 34 of the fourth embodiment, triggered by the cueing motion detected by the cue detection module 38, provides instruction for the performance device 12 to start the automatic performance of the musical piece. Specifically, the performance control module 34 starts the instruction of the automatic performance (that is, outputs the instruction data) to the performance device 12, such that the automatic performance of the musical piece by the performance device 12 starts at the target time point after the cueing interval has elapsed from the point in time of the cueing motion. Accordingly, at the target time point, the actual performance of the musical piece by the plurality of performers P and the actual performance by the performance device 12 are started essentially at the same time.

The music file IF of the fourth embodiment includes control data C4 for controlling the automatic performance of the performance device 12 according to the cueing motion detected by the cue detection module 38 as the control data C. The control data C4 is used to provide instruction for the control of the automatic performance utilizing the cueing motion. More specifically, the performance control module 34 of the fourth embodiment synchronizes the automatic performance of the performance device 12 with the cueing motion detected by the cue detection module 38 in the control target part Q of the musical piece designated by the control data C4. In sections other than the control target part Q, on the other hand, the performance control module 34 stops the control of the automatic performance according to the cueing motion detected by the cue detection module 38. Accordingly, in sections other than the control target part Q, the cueing motion of the specific performer P is not reflected in the automatic performance. That is, the control data C4 is used to provide instruction regarding whether to control the automatic performance according to the cueing motion.

As described above, in the fourth embodiment, the automatic performance is synchronized with the cueing motion in the control target part Q of the musical piece designated by the control data C4. Accordingly, an automatic performance that is synchronized with the cueing motion by the specific performer P is realized. On the other hand, it is possible that an unintended motion of the specific performer P will be mistakenly detected as the cueing motion. In the fourth embodiment, the control for synchronizing the automatic performance and the cueing motion is limited to within the control target part Q in the musical piece. Accordingly, there is the advantage that even if the cueing motion of the specific performer P is mistakenly detected in a location other than the control target part Q, the possibility of the cueing motion being reflected in the automatic performance is reduced.

Fifth Embodiment

The music file F of the fifth embodiment includes control data C5 for controlling the estimation of the performance position T by the performance analysis module 32 as the control data C. The control data C5 is used to provide instruction to the performance analysis module 32 to stop the estimation of the performance position T. Specifically, the performance analysis module 32 of the fifth embodiment stops the estimation of the performance position T in the control target part Q designated by the control data C5. In sections other than the control target part Q, on the other hand, the performance analysis module 32 sequentially estimates the performance position T, parallel with the actual performance of the plurality of performers P, in the same manner as in the first embodiment.

For example, the control data C5 is generated in advance such that locations in the musical piece in which an accurate estimation of the performance position T is difficult are included in the control target part Q. That is, the estimation of the performance position T is stopped in locations of the musical piece in which an erroneous estimation of the performance position T is likely to occur. Accordingly, in the fifth embodiment, the possibility of the performance analysis module 32 mistakenly estimating the performance position T can be reduced (and, thus, also the possibility of the result of an erroneous estimation of the performance position T being reflected in the automatic performance). In addition, there is the advantage that the processing load on the electronic controller 22 is decreased, compared to a configuration in which the performance position T is estimated regardless of whether the performance position is inside or outside the control target part Q.

Sixth Embodiment

The display control module 36 of the sixth embodiment can notify a plurality of performers P of the target time point in the musical piece by changing the performance image G that is displayed on the display device 16. Specifically, by displaying a moving image that represents a state in which the virtual performer H makes a cueing motion on the display device 16 as the performance image G, the display control module 36 notifies each performer P of the point in time after a prescribed cueing interval has elapsed from said cueing motion as the target time point. The operation of the display control module 36 to change the performance image G so as to simulate the normal performance motion of the virtual performer H, parallel with the automatic performance of the performance device 12, is continuously executed while the automatic performance of the musical piece is being executed. That is, a state in which the virtual performer H abruptly makes the cueing motion, parallel with the normal performance motion, is simulated by the performance image G.

The music file F of the sixth embodiment includes control data C6 for controlling the display of the performance image by the display control module 36 as the control data C. The control data C6 is used to provide instruction regarding the notification of the target time point by the display control module 36 and are generated in advance such that locations at which the virtual performer H should make the cueing motion for instructing the target time point are included in the control target part Q.

The display control module 36 of the sixth embodiment notifies each performer P of the target time point in the musical piece by changing the performance image G that is displayed on the display device 16, in the control target part Q of the musical piece designated by the control data C6. Specifically, the display control module 36 changes the performance image G such that the virtual performer H makes the cueing motion in the control target part Q. The plurality of performers P grasp the target time point by visually confirming the performance image G displayed on the display device 16 and start the actual performance at said target time point. Accordingly, at the target time point, the actual performance of the musical piece by the plurality of performers P and the actual performance by the performance device 12 are started essentially at the same time. In sections other than the control target part Q, on the other hand, the display control module 36 expresses a state in which the virtual performer H continuously carries out the normal performance motion with the performance image G.

As described above, in the sixth embodiment, it is possible to visually notify each performer P of the target time point of the musical piece by means of changes in the performance image G, in the control target part Q of the musical piece designated by the control data C6. Accordingly, it is possible to synchronize the automatic performance and the actual performance with each other at the target time point.

MODIFIED EXAMPLE

Each of the embodiments exemplified above can be variously modified. Specific modified embodiments are illustrated below. Two or more embodiments arbitrarily selected from the following examples can be appropriately combined as long as they are not mutually contradictory.

(1) Two or more configurations arbitrarily selected from the first to the sixth embodiments can be combined. For example, it is possible to employ a configuration in which two or more types of control data C arbitrarily selected from the plurality of types of control data C (C1-C6), illustrated in the first to the sixth embodiments, are combined and included in the music file F. That is, it is possible to combine two or more configurations freely selected from:

(A) Initialization of the tempo of the automatic performance in accordance with the control data C1 (first embodiment), (B) Maintenance of the tempo of the automatic performance in accordance with the control data C2 (second embodiment), (C) Control of the performance reflection degree in accordance with the control data C3 (third embodiment), (D) Operation to reflect the cueing motion in the automatic performance in accordance with the control data C4 (fourth embodiment), (E) Stopping the estimation of the performance position T in accordance with the control data C5 (fifth embodiment), and (F) Control of the performance image G in accordance with the control data C6 (sixth embodiment).

In a configuration in which a plurality of types of control data C are used in combination, the control target part Q is individually set for each type of control data C.

(2) In the above-mentioned embodiment, the cueing motion is detected by analyzing the image signal V captured by the image capture device 18, but the method for detecting the cueing motion with the cue detection module 38 is not limited to the example described above. For example, the cue detection module 38 can detect the cueing motion by analyzing a detection signal from a detector (for example, various sensors, such as an acceleration sensor) mounted on the body of the specific performer P. However, the configuration of the above-mentioned fourth embodiment in which the cueing motion is detected by analyzing the image captured by the image capture device 18 has the benefit of the ability to detect the cueing motion with reduced influence on the performance motion of the specific performer P, compared to a case in which a detector is mounted on the body of the specific performer P.

(3) In addition to advancing the automatic performance at the same tempo as the actual performance by the plurality of performers P, for example, the sound volume of the automatic performance can be controlled by using data (hereinafter referred to as "volume data") Ca for controlling the sound volume of the automatic performance. The sound volume data Ca designates the control target part Q in the musical piece, and the temporal change in the sound volume in said control target part Q. The sound volume data Ca is included in the music file F in addition to the reference data R, the performance data D, and the control data C. For example, an increase or decrease of the sound volume in the control target part Q is designated by the sound volume data Ca. The performance control module 34 controls the sound volume of the automatic performance of the performance device 12 in the control target part Q in accordance with the sound volume data Ca. Specifically, the performance control module 34 sets the intensity indicated by the instruction data in the performance data D to a numerical value designated by the sound volume data Ca. Accordingly, the sound volume of the automatic performance increases or decreases over time. In sections other than the control target part Q, on the other hand, the performance control module 34 does not control the sound volume in accordance with the sound volume data Ca. Accordingly, the automatic performance is carried out at the intensity (sound volume) designated by the instruction data in the performance data D. By means of the configuration described above, it is possible to realize a diverse automatic performance in which the sound volume of the automatic performance is changed in specific parts of the musical piece (control target part Q).

(4) As exemplified in the above-described embodiments, the automatic performance system 100 is realized by cooperation between the electronic controller 22 and the program. The program according to a preferred aspect causes a computer to function as the performance analysis module 32 for estimating the performance position T in the musical piece by analyzing the performance of the musical piece by the performer, and as the performance control module 34 for causing the performance device 12 to execute the automatic performance corresponding to performance data D that designates the performance content of the musical piece so as to be synchronized with the progress of the performance position T, wherein the performance control module 34 controls the relationship between the progress of the performance position T and the automatic performance in accordance with the control data C that is independent of the performance data D. The program exemplified above can be stored on a computer-readable storage medium and installed in a computer.

The storage medium is, for example, a non-transitory (non-transitory) storage medium, a good example of which is an optical storage medium, such as a CD-ROM, but can include known arbitrary storage medium formats, such as semiconductor storage media and magnetic storage media. "Non-transitory storage media" include any computer-readable storage medium that excludes transitory propagating signals (transitory propagating signal) and does not exclude volatile storage media. Furthermore, the program can be delivered to a computer in the form of distribution via a communication network.

(5) Preferred aspects that can be ascertained from the specific embodiments exemplified above are illustrated below.

In the performance control method according to a preferred aspect (first aspect), a computer estimates a performance position in a musical piece by analyzing a performance of the musical piece by a performer, causes a performance device to execute an automatic performance corresponding to performance data that designates the performance content of the musical piece so as to be synchronized with the progress of the performance position, and controls the relationship between the progress of the performance position and the automatic performance in accordance with control data that is independent of the performance data. In the aspect described above, since the relationship between the progress of the performance position and the automatic performance is controlled in accordance with the control data, which is independent of the performance data, compared to a configuration in which only the performance data is used to control the automatic performance by the performance device, it is possible to appropriately control the automatic performance according to the performance position so as to reduce problems that can be assumed likely to occur during synchronization of the automatic performance with the actual performance.

In a preferred example (second aspect) of the first aspect, during control of the relationship between the progress of the performance position and the automatic performance, the control for synchronizing the automatic performance with the progress of the performance position is canceled in a part of the musical piece designated by the control data. In the aspect described above, the control for synchronizing the automatic performance with the progress of the performance position is canceled in a part of the musical piece designated by the control data. Accordingly, it is possible to realize an appropriate automatic performance in parts of the musical piece in which the automatic performance should not be synchronized with the progress of the performance position.

In a preferred example (third aspect) of the second aspect, during control of the relationship between the progress of the performance position and the automatic performance, the tempo of the automatic performance is initialized to a prescribed value designated by the performance data, in a part of the musical piece designated by the control data. In the aspect described above, the tempo of the automatic performance is initialized to a prescribed value designated by the performance data, in a part of the musical piece designated by the control data. Accordingly, there is the advantage that the possibility of the tempo of the automatic performance changing unnaturally in conjunction with the tempo of the actual performance in the part designated by the control data is reduced.

In a preferred example (fourth aspect) of the second aspect, during control of the relationship between the progress of the performance position and the automatic performance, in a part of the musical piece designated by the control data, the tempo of the automatic performance is maintained at the tempo of the automatic performance immediately before said part. In the aspect described above, in a part of the musical piece designated by the control data, the tempo of the automatic performance is maintained at the tempo of the automatic performance immediately before said part. Accordingly, it is possible to realize the automatic performance at the appropriate tempo in parts of the musical piece where the tempo of the automatic performance should be maintained, even if the tempo of the actual performance changes.

In a preferred example (fifth aspect) of the first to the fourth aspects, during control of the relationship between the progress of the performance position and the automatic performance, a degree to which the progress of the performance position is reflected in the automatic performance is controlled in accordance with the control data, in a part of the musical piece designated by the control data. In the aspect described above, the degree to which the progress of the performance position is reflected in the automatic performance is controlled in accordance with the control data, in a part of the musical piece designated by the control data. Accordingly, it is possible to realize a diverse automatic performance in which the degree to which the automatic performance follows the actual performance is changed in specific parts of the musical piece.

In a preferred example (sixth aspect) of the first to the fifth aspects, sound volume of the automatic performance is controlled in accordance with sound volume data, in a part of the musical piece designated by the sound volume data. By means of the aspect described above, it is possible to realize a diverse automatic performance in which the sound volume is changed in specific parts of the musical piece.

In a preferred example (seventh aspect) of the first to the sixth aspects, the computer detects a cueing motion by a performer of the musical piece and causes the automatic performance to synchronize with the cueing motion in a part of the musical piece designated by the control data. In the aspect described above, the automatic performance is caused to synchronize with the cueing motion in a part of the musical piece designated by the control data. Accordingly, an automatic performance that is synchronized with the cueing motion by the performer is realized. On the other hand, the control for synchronizing the automatic performance and the cueing motion is limited to the part of the musical piece designated by the control data. Accordingly, even if the cueing motion is mistakenly detected in a location unrelated to said part, the possibility of the cueing motion being reflected in the automatic performance is reduced.

In a preferred example (eighth aspect) of the first to the seventh aspects, estimation of the performance position is stopped in a part of the musical piece designated by the control data. In the aspect described above, the estimation of the performance position is stopped in a part of the musical piece designated by the control data. Accordingly, by means of specifying, with the control data, parts where an erroneous estimation of the performance position is likely to occur, the possibility of mistakenly estimating the performance position can be reduced.

In a preferred example (ninth aspect) of the first to the eighth aspects, the computer causes a display device to display a performance image representing the progress of the automatic performance and notifies the performer of a specific point in the musical piece by changing the performance image in a part of the musical piece designated by the control data. In the aspect described above, the performer is notified of the specific point in the musical piece by the change in the performance image in a part of the musical piece designated by the control data. Accordingly, it is possible to visually notify the performer of the point in time at which the performance of the musical piece is started or the point in time at which the performance is resumed after a long rest.

In a preferred example (tenth aspect) of the first to the ninth aspects, the performance data and the control data are included in one music file. In the aspect described above, since the performance data and the control data are included in one music file, there is the advantage that it is easier to handle the performance data and the control data, compared to a case in which the performance data and the control data constitute separate files.

In the performance control method according to a preferred aspect (eleventh aspect), a computer estimates a performance position in a musical piece by analyzing a performance of the musical piece by a performer, causes a performance device to execute an automatic performance corresponding to performance data that designates a performance content of the musical piece so as to be synchronized with progress of the performance position, and stops the estimation of the performance position in a part of the musical piece designated by control data, which is independent of the performance data. In the aspect described above, the estimation of the performance position is stopped, in a part of the musical piece designated by the control data. Accordingly, by means of specifying, with the control data, parts where an erroneous estimation of the performance position is likely to occur, the possibility of mistakenly estimating the performance position can be reduced.

In the performance control method according to a preferred aspect (twelfth aspect), a computer estimates a performance position in a musical piece by analyzing a performance of the musical piece by a performer, causes a performance device to execute an automatic performance corresponding to performance data that designates performance content of the musical piece so as to be synchronized with progress of the performance position, causes a display device to display a performance image representing the progress of the automatic performance, and notifies the performer of a specific point in the musical piece by changing the performance image in a part of the musical piece designated by the control data. In the aspect described above, the performer is notified of the specific point in the musical piece by the change in the performance image in a part of the musical piece designated by the control data. Accordingly, it is possible to visually notify the performer of the point in time at which the performance of the musical piece is started or the point in time at which the performance is resumed after a long rest.

A performance control device according to a preferred aspect (thirteenth aspect) comprises a performance analysis module for estimating a performance position in a musical piece by analyzing a performance of the musical piece by a performer, and a performance control module for causing a performance device to execute an automatic performance corresponding to performance data that designates the performance content of the musical piece so as to be synchronized with the progress of the performance position, wherein the performance control module controls the relationship between the progress of the performance position and the automatic performance in accordance with control data that is independent of the performance data. In the aspect described above, since the relationship between the progress of the performance position and the automatic performance is controlled in accordance with the control data, which is independent of the performance data, compared to a configuration in which only the performance data is used to control the automatic performance by the performance device, it is possible to appropriately control the automatic performance according to the performance position so as to reduce problems that can be assumed likely to occur during synchronization of the automatic performance with the actual performance.

A performance control device according to a preferred aspect (fourteenth aspect) comprises a performance analysis module for estimating a performance position in a musical piece by analyzing a performance of the musical piece by a performer, and a performance control module for causing a performance device to execute an automatic performance corresponding to performance data that designates the performance content of the musical piece so as to be synchronized with progress of the performance position, wherein the performance analysis module stops the estimation of the performance position in a part of the musical piece designated by control data, which is independent of the performance data. In the aspect described above, the estimation of the performance position is stopped in a part of the musical piece designated by the control data. Accordingly, by means of specifying with the control data those parts where an erroneous estimation of the performance position is likely to occur, the possibility of mistakenly estimating the performance position can be reduced.

A performance control device according to a preferred aspect (fifteenth aspect) comprises a performance analysis module for estimating a performance position in a musical piece by analyzing a performance of the musical piece by a performer, a performance control module for causing a performance device to execute an automatic performance corresponding to performance data that designates the performance content of the musical piece so as to be synchronized with the progress of the performance position, and a display control module for causing a display device to display a performance image representing the progress of the automatic performance, wherein the display control module notifies the performer of a specific point in the musical piece by changing the performance image in a part of the musical piece designated by the control data. In the aspect described above, the performer is notified of the specific point in the musical piece by the change in the performance image in a part of the musical piece designated by the control data. Accordingly, it is possible to visually notify the performer of the point in time at which the performance of the musical piece is started or the point in time at which the performance is resumed after a long rest.

What is claims:

1. A performance control method, comprising:

estimating, by an electronic controller, a performance position in a musical piece by analyzing a performance of the musical piece by a performer;

causing, by the electronic controller, a performance device to execute an automatic performance in accordance with performance data designating performance content of the musical piece, so as to be synchronized with progress of the performance position; and controlling, by the electronic controller, a relationship between the progress of the performance position and the automatic performance in accordance with control data that is independent of the performance data, wherein in the controlling of the relationship between the progress of the performance position and the automatic performance, control for synchronizing the automatic performance with the progress of the performance position is canceled in a part of the musical piece designated by the control data.

2. The performance control method according to claim 1, wherein in the controlling of the relationship between the progress of the performance position and the automatic performance, tempo of the automatic performance in the part of the musical piece designated by the control data is initialized to a prescribed value designated by the performance data.

3. The performance control method according to claim 1, wherein in the controlling of the relationship between the progress of the performance position and the automatic performance, tempo of the automatic performance in the part of the musical piece designated by the control data is maintained at tempo of the automatic performance immediately before the part.

4. The performance control method according to claim 1, wherein in the controlling of the relationship between the progress of the performance position and the automatic performance, a degree to which the progress of the performance position is reflected in the automatic performance is controlled, in accordance with the control data, in a part of the musical piece designated by the control data.

5. The performance control method according to claim 1, further comprising controlling, by the electronic controller, sound volume of the automatic performance in a part of the musical piece designated by sound volume data in accordance with the sound volume data.

6. A performance control method, comprising:

estimating, by an electronic controller, a performance position in a musical piece by analyzing a performance of the musical piece by a performer;

causing, by the electronic controller, a performance device to execute an automatic performance in accordance with performance data designating performance content of the musical piece, so as to be synchronized with progress of the performance position;

controlling, by the electronic controller, a relationship between the progress of the performance position and the automatic performance in accordance with control data that is independent of the performance data;

detecting, by the electronic controller, a cueing motion by the performer of the musical piece; and causing, by the electronic controller, the automatic performance to be synchronized with the cueing motion in a part of the musical piece designated by the control data.

7. The performance control method according to claim 1, wherein the estimating of the performance position is stopped in a part of the musical piece designated by the control data.

8. A performance control method, comprising:

estimating, by an electronic controller, a performance position in a musical piece by analyzing a performance of the musical piece by a performer;

causing, by the electronic controller, a performance device to execute an automatic performance in accordance with performance data designating performance content of the musical piece, so as to be synchronized with progress of the performance position;

controlling, by the electronic controller, a relationship between the progress of the performance position and the automatic performance in accordance with control data that is independent of the performance data;

causing, by the electronic controller, a display device to display a performance image representing the progress of the automatic performance; and notifying, by the electronic controller, the performer of a specific point in the musical piece by changing the performance image in a part of the musical piece designated by the control data.

9. The performance control method according to claim 1, wherein the performance data and the control data are included in one music file.

10. A performance control device, comprising:

an electronic controller including at least one processor, the electronic controller being configured to execute a plurality of modules including a performance analysis module that estimates a performance position in a musical piece by analyzing a performance of the musical piece by a performer, and a performance control module that causes a performance device to execute an automatic performance corresponding to performance data designating performance content of the musical piece so as to be synchronized with progress of the performance position, the performance control module controlling a relationship between the progress of the performance position and the automatic performance in accordance with control data that is independent of the performance data, the performance control module cancelling control for synchronizing the automatic performance with the progress of the performance position in a part of the musical piece designated by the control data, to control the relationship between the progress of the performance position and the automatic performance.

11. The performance control device according to claim 10, wherein the performance control module initializes tempo of the automatic performance in the part of the musical piece designated by the control data to a prescribed value designated by the performance data, to control the relationship between the progress of the performance position and the automatic performance.

12. The performance control device according to claim 10, wherein the performance control module maintains tempo of the automatic performance in the part of the musical piece designated by the control data at tempo of the automatic performance immediately before the part, to control the relationship between the progress of the performance position and the automatic performance.

13. The performance control device according to claim 10, wherein the performance control module controls a degree to which the progress of the performance position is reflected in the automatic performance, in accordance with the control data, in a part of the musical piece designated by the control data, to control the relationship between the progress of the performance position and the automatic performance.

14. The performance control device according to claim 10, wherein the performance control module further controls sound volume of the automatic performance in a part of the musical piece designated by sound volume data in accordance with the sound volume data.

15. The performance control device according to claim 10, wherein the electronic controller further includes a cue detection module that detects a cueing motion by the performer of the musical piece, and the performance control module causes the automatic performance to be synchronized with the cueing motion in a part of the musical piece designated by the control data.

16. The performance control device according to claim 10, wherein the performance analysis module stops estimation of the performance position in a part of the musical piece designated by the control data.

17. The performance control device according to claim 10, wherein the electronic controller further includes a display control module that causes a display device to display a performance image representing the progress of the automatic performance, and notifies the performer of a specific point in the musical piece by changing the performance image in a part of the musical piece designated by the control data.

18. The performance control device according to claim 10, wherein the electronic controller further includes one music file that includes the performance data and the control data.

* * * * *